United States Patent [19]

Adams et al.

[11] 4,373,357

[45] Feb. 15, 1983

[54] CRYOGENIC COOLING APPARATUS

[75] Inventors: Norman H. Adams, Redditch; David N. Campbell, King's Coughton, both of England

[73] Assignee: The Hymatic Engineering Company Limited, England

[21] Appl. No.: 309,830

[22] Filed: Oct. 8, 1981

[30] Foreign Application Priority Data

Oct. 10, 1980 [GB] United Kingdom ..... 8032822

[51] Int. Cl.[3] ..... F25B 19/00

[52] U.S. Cl. ..... 62/514 JT

[58] Field of Search ..... 62/514 JT

[56] References Cited

U.S. PATENT DOCUMENTS 3,704,598 12/1972 Campbell et al. ..... 62/514 JT

FOREIGN PATENT DOCUMENTS 1230079 4/1971 United Kingdom .
1297133 11/1972 United Kingdom .
1368107 9/1974 United Kingdom .

*Primary Examiner*—Ronald C. Capossela

*Attorney, Agent, or Firm*—Price, Heneveld, Huizenga & Cooper

[57] ABSTRACT

Cryogenic cooling apparatus of the type including a generally tubular heat exchanger affording two paths, through one of which, in use, refrigerant gas from a supply under pressure is supplied to a Joule-Thompson expansion nozzle to liquify a portion of the gas in a container where the low pressure gas returns through the other path, and a valve member co-operating with the nozzle to vary its effective area for automatically controlling the flow of the refrigerant. The valve member is actuated via an elongate operating member by a movable wall of a bellows situated within or beyond the heat exchanger and exposed on one side to the pressure of a sensing vapor, which, in operation, is in equilibrium with liquid. The operating member is in the form of a tube whose interior communicates with the space containing the sensing vapor, and extending down to the region of the nozzle so that the heat extracted from the sensing vapor in the operating member is a function of the quantity of liquid refrigerant in contact with the operating member.

8 Claims, 3 Drawing Figures

CRYOGENIC COOLING APPARATUS

BACKGROUND OF THE INVENTION

This invention relates to cryogenic cooling apparatus of the type including a generally tubular heat exchanger affording two paths, through one of which, in use, refrigerant gas from a supply under pressure is supplied to a Joule-Thomson expansion nozzle to liquefy a portion of the gas in a container, whence the low pressure gas returns through the other path, and a valve member co-operating with the nozzle to vary its effective area for automatically controlling the flow of the refrigerant, the valve member being actuated via an elongate operating member by a movable wall, preferably of a bellows, situated within or beyond the heat exchanger, and exposed on one side to the pressure of a sensing vapour which, in operation, is in equilibrium with liquid.

Unlike ordinary thermostatic cooling apparatus, apparatus of the type referred to, in which gaseous refrigerant is liquefied, cannot be controlled by the temperature of the refrigerant since this remains constant so long as refrigerant liquid is in equilibrium with refrigerant vapour at constant pressure. Thus the aim is to control the cooling in accordance with the amount of refrigerant liquid present in the container, either in a pool or in the form of a spray of droplets.

Thus some constructions of this type, as exemplified by those in British patent specification Nos. 1368107 and 1297133, have hitherto been provided with a stationary sensor in the form of a tube communicating with the sensing vapour space, and extending from it down to the region of the valve. Such an arrangement provides a sensitive response to the amount of liquid in contact with the sensor, whether in the form of a pool in the container or in the form of a spray or droplets from the nozzle, but its accomodation in the available space may prove difficult, particularly in the very small coolers often required.

SUMMARY OF THE INVENTION

Thus it is an object of the present invention to provide a cooler of the type referred to whose construction is such that it may be made smaller than has previously been possible.

According to the present invention, the operating member is in the form of a tube whose interior communicates with the space containing the sensing vapour extending down to the region of the nozzle so that the heat extracted from the sensing vapour in the operating member is a function of the quantity of liquid refrigerant in contact with the operating member.

For convenience of description, the cooler is described herein as being in a vertical position with the load at the lower end, although it may operate satisfactorily in other orientations. Its upper end is then described as its warm end as contrasted with its cold end, although in fact the upper end will be at atmospheric temperature while the lower end may be, for example, at the temperature of liquid nitrogen.

One form of the invention includes a bellows fixed at its cold end and subjected on its outside to the pressure of the sensing vapour and liquid, and the operating member extends the full length of the bellows coaxially within it, and is secured to its warm moving end and communicates through it with the sensing vapour space.

In another form of the invention, the bellows is fixed at its warm end and its inner surface is subjected to the pressure of the sensing vapour and liquid, and the operating member is secured to the cold moving end, and communicates through it with the vapour inside it.

In use, refrigerant gas flows through the first path in the heat exchanger, expands through the nozzle thus becoming cooled and then flows back through the second path thereby progressively cooling the incoming gas. When the apparatus reaches its operational temperature the gas stream passing out of the nozzle carries with it droplets of liquified refrigerant and these accumulate in the container around the nozzle, e.g. the inner wall of a Dewar flask. The sensor responds to the rate of heat extraction from it. i.e. to the quantity of liquid refrigerant in contact with it since the liquid extracts very much more heat from the sensor than does gas at the same temperature. Thus the sensor will respond either to the depth of immersion of the sensor in the pool of liquid refrigerant in the container or to the extent to which the surface of the sensor is wetted by droplets of refrigerant. Thus a balance is reached between the heat extracted from the sensor and the heat that flows down through it. The control function occurs when, despite the heat flow down its sufficient heat is extracted from it to liquify a proportion of the sensing vapour within it.

Such an arrangement may indeed be too sensitive in which case the valve member may include means to reduce the rate of thermal transfer through it from liquid refrigerant to the sensing vapour space within the operating member. This prevents the valve being close prematurely, though a small amount of heat transfer through the valve member may be desirable. It will be appreciated that the temperature of a heat load such as an infra-red detector, attached to the wall of the container, will also be a function of the depth of liquid in the container or of the extent to which the container walls are wetted by droplets of refrigerant and the detail design of the sensor and control mechanism may be chosen so that the desired temperature of the load is obtained without producing an excess of refrigerant which would be inefficient.

The known cooling apparatus of the type described in the prior specifications referred to above may be made relatively slender, i.e. down to a diameter of about 5 mm. However, the elimination of a separate sensing member permits this diameter to be reduced even further. In a preferred embodiment of the invention, the bellows is situated wholly beyond the heat exchanger, and this permits the overall diameter of the apparatus to be reduced to 4 mm or even less.

Further features and details of the invention will be apparent from the following description of certain specific embodiments that will be given by way of example, with reference to the accompanying diagrammatic drawings: in which

DESCRIPTION OF THE PREFERRED EMBODIMENTS

Figure 1:
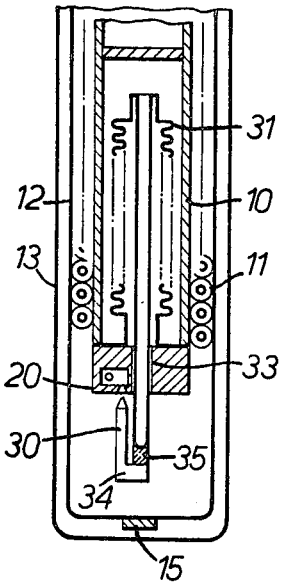
FIGS. 1–3 are respective diagrammatic longitudinal sections of three different forms of cooling apparatus in accordance with the invention.

The coolers shown in the drawings are all generally on the lines described in British Patent Specification No. 1,230,079 or No. 1,297,133 which are both in the name of the present Assignee.

The apparatus includes a tubular heat exchanger comprising an inner tubular body 10 around which is helically wound a finned inlet tube 11 forming the inlet path of the heat exchanger. An external coaxial tube 12, formed in this case by the inner wall of a Dewar flask having an outer wall 13 (shown only in FIG. 1), is located around the finned coil 11 and the space between the inner body and the external tube provides the second or exhaust path of the heat exchanger for exhaust gas flowing past the fins to cool the incoming high pressure refrigerant gas within the helically coiled tube forming the inlet path.

The lower end of the Dewar flash is closed to provide within a a reservoir in which the liquified refrigerant gas can accumulate. A load to be cooled, such as an infra-red radiation detector 15, is formed on, or secured to, the outer face of the inner wall 12 of the Dewar flask.

The upper end of the helical finned tube 11 communicates with a coupling at the upper end of the heat exchanger, to which a gaseous refrigerant such as nitrogen under pressure, is supplied at a temperature below its inversion temperature.

At its lower end, the inner tubular body 10 carries a seating member 20 shown diagrammatically, having an expansion orifice forming a seating for a valve to which the lower end of the helical tube 11 is connected.

The effective area of the expansion orifice is arranged to be controlled by means of a valve needle 30 which is itself controlled by a bellows 31 situated within the lower cold end portion of the heat exchanger. The lower cold end of the bellows is secured to the inner tube 10 while its upper end is secured to the open end of a tubular combined sensor and operating rod 33 which extends down through the cold end of the bellows and is connected at its lower end to an 'L' shaped valve member 34, of which one limb is the needle 30 co-operating with the seating. The valve member is connected by a thermal insulator 35 with a lower closed end of the operating sensor 33. This insulator reduces the rate of thermal transfer along the valve needle and thus oversensitivity of the valve. It will however be appreciated that this could be achieved by a variety of means, such as coating the valve needle wholly or partially with a thermally insulating material.

The space within the bellows communicates with the liquid refrigerant reservoir which is normally at slightly above atmospheric pressure whilst the space surrounding the bellows is charged with a sensor vapour at a pressure which is so chosen that when the sensor is contacted by the desired quantity of liquid refrigerant a proportion of the sensor gas within the sensor, and also the space surrounding the bellows since these two are in communication, liquifies, thus reducing the pressure of the sensing vapour, which in turn causes the valve to be progressively closed.

Accordingly, the arrangement provides an extremely compact, and yet sensitive control of the position of the valve in accordance with the amount of liquid refrigerant in the container.

Figure 2:
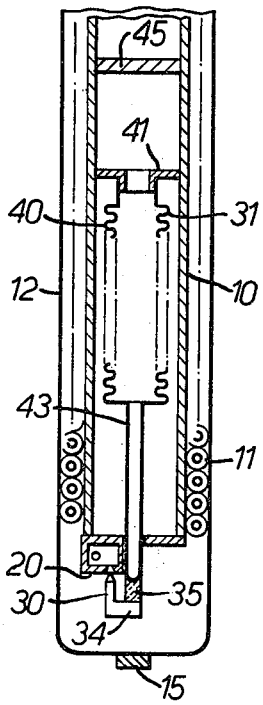

In the arrangement shown in FIG. 1, the sensing vapour space is situated outside the bellows. It may however occupy the inside of the bellows, as shown in FIG. 2. The arrangement of FIG. 2 is very similar to that of FIG. 1, except that the upper warm end 40 of the bellows is stationary, being secured to a ring 41 fixed to the inner tube 10 of the heat exchanger. The lower moving end of the bellows is secured to a combined operating member and sensor 43, the interior of which is connected to that of the bellows, to form the vapour space, while its cold end extends beyond the seating member 20 which again co-operates with a valve needle 30 afforded by an 'L' shaped member. The top of the sensing vapour space is closed by a partition 45.

The precise geography of the parts will depend upon design, and in particular the position of the partition 45 will determine the extent to which the sensing vapour space extends towards the warm end of the heat exchanger. In the arrangement of FIG. 2, it may in certain circumstances be combined with the ring 41 to close the warm upper end of the bellows.

Similarly, the extent to which the operating member and the sensing vapour space extend to or beyond the valve seat 20 may vary in accordance with requirements. FIG. 1 shows an arrangement in which it extends somewhat further than that of FIG. 2. However, under certain circumstances it may be acceptable for the sensing vapour space within the combined operating member and sensor to terminate slightly before the valve seat. This may mean that the valve aperture and even the lower portion of the heat exchanger become submerged in liquid refrigerant thus reducing the efficiency and sensitivity of the cooler, but depending on the circumstances this may be acceptable.

Figure 3:
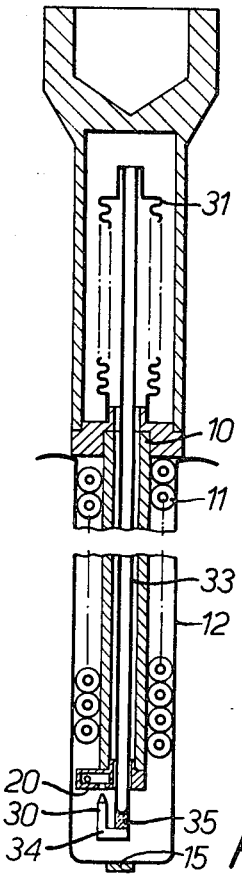

The present applicant's British Patent Specification No. 1,297,133 describes constructions in which, to meet a requirement for a very slender cooler, the bellows is situated beyond the warm end of the heat exchanger. Such an arrangement may incorporate the present invention, as shown in FIG. 3. This is very similar to that of FIG. 1, except that the combined sensor and operating rod 33 extends a considerable distance beyond the warm end of the heat exchanger in a tubular container accommodating the bellows, and forming the vapour space of the sensor. In other respects the construction of FIG. 3 is the same as that of FIG. 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a cryogenic cooling apparatus of the type including a substantially tubular heat exchanger, a Joule-Thompson nozzle and a container, said heat exchanger including a first path communicating with said nozzle through which, in use, refrigerant gas from a supply under pressure is supplied to said nozzle to liquify a portion of said gas in said container whereafter the low pressure gas is exhausted through a second path, said apparatus further including a valve member co-operating with said nozzle to vary its effective area to automatically vary the flow of said refrigerant gas and an operating member operatively connected to said valve member and to a movable wall, said movable wall being exposed on one side, in use, to the pressure of a sensing vapour which in operation is in equilibrium with liquid refrigerant;

the improvement comprising providing said operating member in the form of a combination operating member and sensing tube, said tube having a hollow interior, said interior communicating with the space containing said sensing vapour and extending down to the region of said nozzle whereby, in use, the heat extracted from the sensing vapour in said interior of said operating member is a function of the quantity of liquid refrigerant in contact with said operating member.

2. Apparatus as claimed in claim 1 wherein said movable wall is afforded by a bellows.

3. Apparatus as claimed in claim 2 wherein said bellows has a warm end, a cold end, a length and an external surface, said cold end being fixed, said warm end being movable and said external surface being exposed to the pressure of said sensing vapour and wherein said operating member extends within and along the full length of said bellows and is connected to said warm end and said interior of said operating member communicates with said space containing said sensing vapour which is external of said bellows.

4. Apparatus as claimed in claim 2 wherein said bellows has a warm end, a cold end and an internal surface, said warm end being fixed, said cold end being movable and said internal surface being exposed to the pressure of said sensing vapour and wherein said operating member is connected to said cold end and said interior of said operating member communicates with said space containing said sensing vapour which is within said bellows.

5. Apparatus as claimed in claim 1 or claim 2 wherein said interior of said operating member extends to a point beyond said nozzle.

6. Apparatus as claimed in claim 1 or claim 2 wherein said valve member includes insulator means to reduce the rate of thermal transfer through it from liquid refrigerant to said interior of said operating member.

7. Apparatus as claimed in claim 2 wherein said bellows is situated wholly beyond said exchanger on the side remote from said nozzle.

8. Apparatus as claimed in claim 1 or claim 2 wherein said operating member includes insulation means to reduce the rate of thermal transfer through it from liquid refrigerant to said interior of said operating member.

* * * * *

UNITED STATES PATENT AND TRADEMARK OFFICE

CERTIFICATE OF CORRECTION

PATENT NO. : 4 373 357

DATED : February 15, 1983

INVENTOR(S) : Norman Adams and David Campbell

It is certified that error appears in the above-identified patent and that said Letters Patent is hereby corrected as shown below:

In the Abstract, line 7:

"where" should be --whence--

Column 1, line 36:

"or" (second occurrence) should be --of--

Column 1, line 37:

"accomodation" should be --accommodation--

Column 2, line 23:

"its" should be --it--

Column 2, line 30:

"close" should be --closed--

Column 3, line 14:

"a" (first occurrence) should be --it--

UNITED STATES PATENT AND TRADEMARK OFFICE

CERTIFICATE OF CORRECTION

PATENT NO. : 4 373 357 Page 2 of 2

DATED : February 15, 1983

INVENTOR(S) : Norman Adams and David Campbell

It is certified that error appears in the above-identified patent and that said Letters Patent is hereby corrected as shown below:

Column 6, line 9:

"insulator" should be --insulation--

Signed and Sealed this

*Twentieth* Day of *September 1983*

[SEAL]

*Attest:*

GERALD J. MOSSINGHOFF

*Attesting Officer* *Commissioner of Patents and Trademarks*